US009592674B2

(12) United States Patent
Asamoto et al.

(10) Patent No.: US 9,592,674 B2
(45) Date of Patent: Mar. 14, 2017

(54) LIQUID DROPLET EJECTING APPARATUS

(71) Applicant: SEIKO EPSON CORPORATION, Tokyo (JP)

(72) Inventors: Katsuya Asamoto, Shiojiri (JP); Tsuneyuki Sasaki, Matsumoto (JP); Shuichiro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/000,255

(22) Filed: Jan. 19, 2016

(65) Prior Publication Data

US 2016/0236491 A1 Aug. 18, 2016

(30) Foreign Application Priority Data

Feb. 13, 2015 (JP) ..... 2015-026566

(51) Int. Cl.

| | |
|---|---|
| ***B41J 2/17*** | (2006.01) |
| ***B41J 29/13*** | (2006.01) |
| ***B41J 29/377*** | (2006.01) |
| ***B41J 29/38*** | (2006.01) |
| *B41J 2/185* | (2006.01) |

(52) U.S. Cl.

CPC ..... *B41J 2/1714* (2013.01); *B41J 29/13* (2013.01); *B41J 29/377* (2013.01); *B41J 29/38* (2013.01); *B41J 2002/1853* (2013.01)

(58) Field of Classification Search

CPC ..... B41J 2/1714; B41J 2002/1853

See application file for complete search history.

(56) References Cited

U.S. PATENT DOCUMENTS

| | | | | |
|---|---|---|---|---|
| 5,296,873 A * | 3/1994 | Russell | B41J 2/1714 | 101/424.1 |
| 5,428,384 A * | 6/1995 | Richtsmeier | B41J 2/04515 | 347/102 |
| 6,367,906 B1 | 4/2002 | Hiramatsu et al. | | |
| 6,511,153 B1 * | 1/2003 | Ishikawa | B41J 2/1652 | 347/35 |
| 6,554,411 B1 * | 4/2003 | Hatasa | B41J 2/17503 | 347/86 |

(Continued)

FOREIGN PATENT DOCUMENTS

| | | | |
|---|---|---|---|
| DE | EP 1923216 A2 * | 5/2008 | B41J 2/16526 |
| JP | 05-147204 A | 6/1993 | |

(Continued)

*Primary Examiner* — Justin Seo
(74) *Attorney, Agent, or Firm* — Workman Nydegger

(57) ABSTRACT

A liquid droplet ejecting apparatus includes a transport unit configured to transport a medium in a transport direction, a support configured to support the medium transported by the transport unit, a liquid droplet ejecting portion configured to eject liquid droplets to the medium supported by the support, a carriage configured to reciprocate in a scanning direction intersecting the transport direction while holding the liquid droplet ejecting portion, and an air flow generator configured to create an air flow in an area over the support. The air flow generator limits creation of the air flow when the liquid droplet ejecting portion faces the medium in an ejection direction and allows the creation of the air flow when the liquid droplet ejecting portion does not face the medium in the ejection direction, due to movement of the carriage in the scanning direction.

4 Claims, 4 Drawing Sheets

(56) References Cited

U.S. PATENT DOCUMENTS 6,648,456 B1 * 11/2003 Asano ..... B41J 2/1752 347/49
8,235,509 B2 * 8/2012 Umeda ..... B41J 2/175 347/85
2002/0140761 A1 * 10/2002 Tsurui ..... B41J 2/1714 347/25
2003/0167940 A1 * 9/2003 Haug ..... B41J 2/1714 101/91
2006/0214981 A1 * 9/2006 Fukasawa ..... B41J 2/16523 347/29
2008/0297579 A1 * 12/2008 Umeda ..... B41J 2/175 347/92
2009/0021549 A1 1/2009 Muto
2009/0058915 A1 * 3/2009 Hayashi ..... B41J 2/16585 347/17
2009/0058925 A1 * 3/2009 Hayashi ..... B41J 2/16532 347/30
2010/0084803 A1 * 4/2010 Akihiro ..... B41J 11/007 271/3.22
2010/0097417 A1 * 4/2010 Hill ..... B41J 2/1707 347/9
2010/0118098 A1 * 5/2010 Ebihara ..... B41J 2/155 347/104
2011/0157288 A1 * 6/2011 Morimoto ..... B41J 11/0085 347/104
2012/0001985 A1 * 1/2012 Kumagai ..... B41J 2/155 347/34
2012/0007916 A1 * 1/2012 Kumagai ..... B41J 2/16517 347/34
2012/0062640 A1 * 3/2012 Uraki ..... B41J 2/15 347/18
2014/0176655 A1 * 6/2014 Hattori ..... B41J 13/226 347/104
2014/0253623 A1 * 9/2014 Nakano ..... B41J 11/0045 347/16
2014/0267524 A1 * 9/2014 Wanibuchi ..... B41J 11/0085 347/104
2014/0292854 A1 * 10/2014 Tanaka ..... B41J 2/1714 347/9
2015/0314616 A1 * 11/2015 Shinjo ..... B41J 29/377 347/102
2015/0344249 A1 * 12/2015 Inoue ..... B65H 29/52 347/102
2016/0279949 A1 * 9/2016 Suzuki ..... B41J 2/175

FOREIGN PATENT DOCUMENTS

JP 11-138780 A 5/1999
JP 2003-220695 A 8/2003
JP 2007-223129 A 9/2007

* cited by examiner

LIQUID DROPLET EJECTING APPARATUS

BACKGROUND

1. Technical Field

The present invention relates to a liquid droplet ejecting apparatus including an inkjet printer.

2. Related Art

As an example of a liquid droplet ejecting apparatus, an inkjet printer is widely known. The inkjet printer is configured to eject ink, which is an example of a liquid droplet, from a liquid droplet ejecting portion to a medium supported by a support so as to form characters and images. The inkjet printer includes a fan in some cases in order to create an air flow in a housing of the inkjet printer. The air flow allows an ink mist, which is generated in the housing during ejection of the ink from the liquid droplet ejecting portion, to be discharged outside the housing (see, JP-A-11-138780, for example).

When the air flow is created in the housing of the above-described printer, an output of the fan needs to be controlled such that the air flow created by the fan forces the ink mist to be discharged outside the housing without having an influence on a traveling state of the liquid droplets, which are ejected from the liquid droplet ejecting portion to the medium.

In the above-described printer, if the air flow in the housing is decreased so as not to have an influence on the traveling state of the liquid droplets, which are ejected from the liquid droplet ejecting portion to the medium, the air flow may be too weak to force the ink mist to be discharged outside the housing. If the air flow created in the housing is increased so as to force the ink mist to be discharged outside the housing, the air flow may have an influence on the traveling state of the liquid droplets, which are ejected from the liquid droplet ejecting portion to the medium.

Such problems are generally common to liquid droplet ejecting apparatuses in which a mist of liquid droplets may be generated during ejection of the liquid droplets to a medium and foreign substances such as dust may exist in the housing.

SUMMARY

An advantage of some aspects of the invention is that a liquid droplet ejecting apparatus configured to eliminate foreign substances such as mist generated during ejection of liquid droplets without having an influence on the traveling state of the liquid droplets ejected from the liquid droplet ejecting portion to the medium is provided.

Hereinafter, means for solving the above-described problems and operations and effects obtained by the means are described.

A liquid droplet ejecting apparatus that solves the above-described problems includes a transport unit configured to transport a medium in a transport direction, a support configured to support the medium transported by the transport unit, a liquid droplet ejecting portion configured to eject liquid droplets to the medium supported by the support, a carriage configured to reciprocate in a scanning direction intersecting the transport direction while holding the liquid droplet ejecting portion, and an air flow generator configured to create an air flow in an area over the support, wherein a direction in which the liquid droplets ejected from the liquid droplet ejecting portion travel is an ejection direction, and the air flow generator limits creation of the air flow when the liquid droplet ejecting portion faces the medium in the ejection direction and allows the creation of the air flow when the liquid droplet ejecting portion does not face the medium in the ejection direction, due to movement of the carriage in the scanning direction.

In the above-described configuration, the liquid droplets are ejected from the liquid droplet ejecting portion, which is supported by the carriage reciprocating in the scanning direction, to the medium. The ejection of the liquid droplets from the liquid droplet ejecting portion may generate a mist of droplets smaller than the liquid droplets and floating in an area over the support. In addition, foreign substances such as dust may enter and float in the area over the support due to the transport of the medium.

In the above-described configuration, the air flow is created in the area over the support when the liquid droplet ejecting portion does not face the medium, i.e., when the liquid droplet ejecting portion does not eject the liquid droplets to the medium, to eliminate the foreign substances such as the mist floating in the area over the support.

When the liquid droplet ejecting portion faces the medium, i.e., when the liquid droplet ejecting portion is ready to eject the liquid droplets to the medium, the creation of the air flow in the area over the support is limited. Thus, the travelling state of the liquid droplets, which are ejected from the liquid droplet ejecting portion to the medium, is unlikely to be affected by the air flow created in the area over the support during the ejection of the liquid droplets from the liquid droplet ejecting portion to the medium.

The above-described configuration is able to eliminate foreign substances such as the mist floating in the area over the support without having an influence on the traveling state of the liquid droplets, which are ejected from the liquid droplet ejecting portion to the medium, irrespective of the strength of the air flow.

In the above-described liquid droplet ejecting apparatus, the air flow created in the area over the support may be a first air flow, the area over the support may be a first area, and the air flow generator may be configured to create a second air flow in a second area upstream of the support in the transport direction and through which the medium passes, in addition to the first air flow.

In the above-described configuration, the second air flow created in the second area is able to eliminate foreign substances such as dust on the surface of the medium to be transported to the support. As a result, the liquid droplets are ejected to the medium having a smaller amount of foreign substances thereon.

In the above-described liquid droplet ejecting apparatus, the air flow generator may include a first outlet through which air forming the first air flow is expelled, a second outlet through which air forming the second air flow is expelled, a gas chamber configured to be in communication with the first outlet and the second outlet, an air supplier configured to send air to the gas chamber, and a switching portion switchable between a communication state, in which the first outlet and the gas chamber are in communication with each other, and a non-communication state, in which the first outlet and the gas chamber are not in communication with each other.

In the above-described configuration, when the liquid droplet ejecting portion does not face the medium, the switching portion is switched to be in the communication state. This allows the first air flow to be created in the first area over the support and the second air flow to be created in the second area upstream of the support in the transport direction. When the liquid droplet ejecting portion faces the medium, the switching portion is switched to be in the non-communication state. This prevents or reduces the creation of the first air flow in the first area while allowing the creation of the second air flow in the second area.

In addition, when the liquid droplet ejecting portion faces the medium, i.e., the switching portion is in the non-communication state, air forming the first air flow is not expelled through the first outlet. Thus, a large amount of air forming the second air flow is expelled through the second outlet compared with the case where the switching portion is in the communication state. In other words, according to this configuration, when the liquid droplet ejecting portion faces the medium, the creation of the first air flow is limited and the second air flow is increased compared with the case where the liquid droplet ejecting portion does not face the medium. Thus, the foreign substances such as dust is readily eliminated from the second area.

In the above-described liquid droplet ejecting apparatus, the switching portion may be in the communication state when the transport unit transports the medium and may be in the non-communication state when the transport unit does not transport the medium.

In the liquid droplet ejecting apparatus configured to eject the liquid droplets from the liquid droplet ejecting portion, which is supported by the carriage reciprocating in the scanning direction intersecting the transport direction, the liquid droplets are not ejected when the medium is being transported, and the liquid droplets are ejected when the medium is not transported. In the above-described configuration, the communication state and the non-communication state are switchable depending on whether the medium is being transported or not. Thus, the state of the switching portion is readily controlled.

In the above-described liquid droplet ejecting apparatus, the air flow generator may further include a heating portion configured to heat the second air flow. Foreign substances such as dust are more likely to be attached to a medium having a high moisture content than to a medium having a low moisture content. With the above-described configuration, the heated second air flow evaporates the moisture in the medium to be transported to the support. Thus, the liquid droplets are likely to be ejected to the medium having a smaller amount of foreign substances such as dust thereon.

The above-described liquid droplet ejecting apparatus may further include a guide extending obliquely upward to a downstream side in the transport direction so as to guide the medium to the support. The second area may be positioned over the guide.

With the above-described configuration, the medium positioned at a lower side in the vertical direction is able to be transported by the guide extending obliquely upward to the downstream side in the transport direction to the support positioned at an upper side in the vertical direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a liquid droplet ejecting apparatus 10 is described with reference to the drawings. The liquid droplet ejecting apparatus 10 is a large format printer, for example, which is configured to eject ink to a long medium M (sheet) to print characters and images on the medium M. The ink is an example of the liquid droplet.

Figure 1:
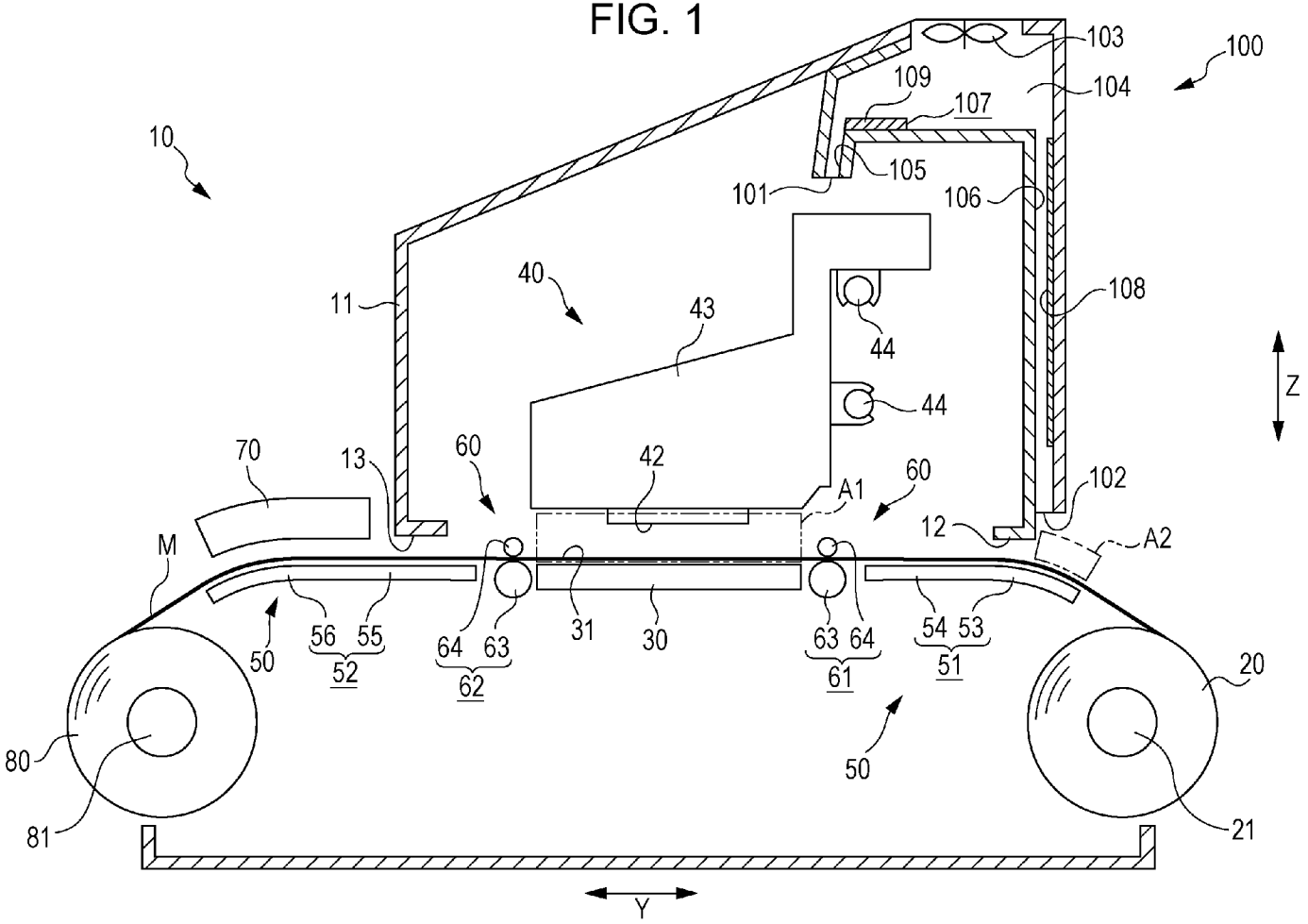
FIG. 1 is a cross-sectional side view illustrating a schematic configuration of a liquid droplet ejecting apparatus.
Figure 2:
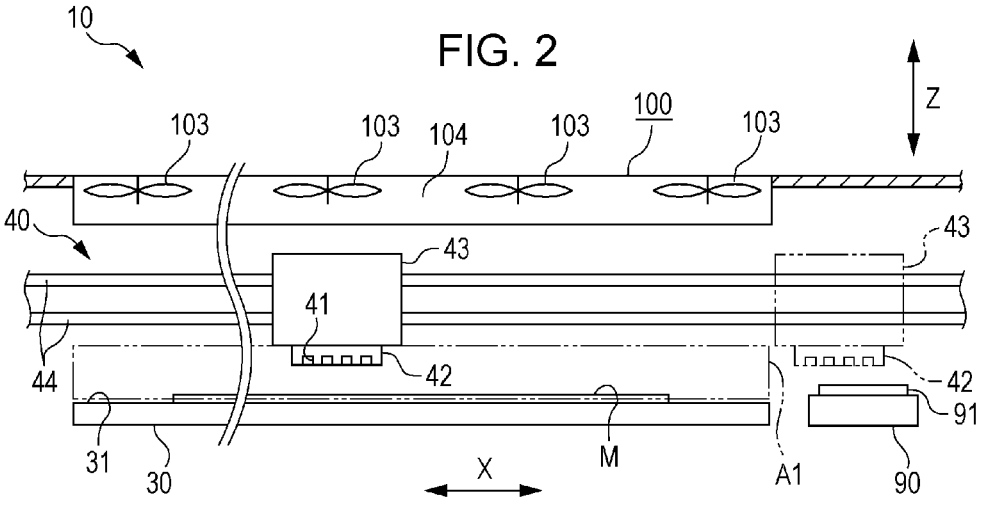
FIG. 2 is a cross-sectional front view schematically illustrating a schematic configuration of the liquid droplet ejecting apparatus.

As illustrated in FIG. 1 and FIG. 2, the liquid droplet ejecting apparatus 10 includes a feeder 20 configured to send the medium M, a support 30 configured to support the medium M, a liquid droplet ejecting unit 40 configured to eject liquid droplets to the medium M, a guide 50 configured to guide the medium M, and a transport unit 60 configured to transport the medium M. The liquid droplet ejecting apparatus 10 further includes a heater 70 configured to heat the medium M, a take-up portion 80 configured to take up the medium M, a maintenance portion 90 (FIG. 2) configured to maintain the liquid droplet ejecting unit 40, and an air flow generator 100 configured to create air flow flowing along the medium M positioned in and/or outside a housing 11.

In the description below, a direction perpendicular to the drawing plane in FIG. 1 is referred to as a width direction X (see FIG. 2), a horizontal direction in FIG. 1, which intersects or is perpendicular to the width direction X, is referred to as a front-rear direction Y, and an up-down direction in FIG. 1, which intersects or is perpendicular to both the width direction X and the front-rear direction Y is referred to as a vertical direction Z. A movement direction of the medium M from the feeder 20 to the take-up portion 80 is referred to as a transport direction. An upstream side and a downstream side are defined based on the transport direction.

As illustrated in FIG. 1, the feeder 20 includes a feeding roller 21 around which the long medium M is wound. The feeder 20 sends the medium M to the downstream side in the transport direction when the feeding roller 21 is rotated in a counterclockwise direction in FIG. 1.

As illustrated in FIG. 1 and FIG. 2, the support 30 has a rectangular plate shape. The support 30 has a long side and a short side extending in the width direction X and in the front-rear direction Y, respectively. The support 30 has a support surface 31 that supports the medium M from below in the vertical direction Z. The support surface 31 may have vacuum holes that cause the medium M to adhere to the support surface 31. This prevents the medium M from rising. Hereinafter, an area over the support 30 (support surface 31) in the housing 11 may be referred to as a first area A1.

As illustrated in FIG. 1 and FIG. 2, the liquid droplet ejecting unit 40 includes a liquid droplet ejecting portion 42 including nozzles 41 through which liquid droplets are ejected, a carriage 43 holding the liquid droplet ejecting portion 42 such that the nozzles 41 open toward the support 30, and guide shafts 44 supporting the carriage 43 so as to allow the carriage 43 to reciprocate in the width direction X. The liquid droplet ejecting unit 40 allows the liquid droplets to be ejected through the nozzles 41 of the liquid droplet ejecting portion 42 to the medium M while allowing the carriage 43 to reciprocate in the width direction X. In this embodiment, the width direction X is an example of a scanning direction of the carriage 43.

The first area A1 at least includes an area where the liquid droplets ejected from the liquid droplet ejecting portion 42 travel, i.e., an area between the liquid droplet ejecting portion 42 reciprocating in the width direction X and the medium M supported by the support 30. In this embodiment, a direction in which the liquid droplets ejected from the liquid droplet ejecting portion 42 travel is referred to as an ejection direction. The ejection direction intersects or is perpendicular to both the front-rear direction Y and the width direction X (i.e., downward in the vertical direction).

As illustrated in FIG. 1, the transport unit 60 includes a first transport roller 61 disposed upstream of the support 30 in the transport direction, and a second transport roller 62 disposed downstream of the support 30 in the transport direction. The first and second transport rollers 61 and 62 each include a driving roller 63 and a driven roller 64. The driving roller 63 in contact with the medium M applies a movement force to the medium M when rotated. The medium M being transported rotates the driven roller 64 in contact with the medium M. The transport unit 60 drives the driving roller 63 while the medium M is pinched between the driving roller 63 and the driven roller 64 of each of the first and second transport rollers 61 and 62 to transport the medium M to the downstream side.

As illustrated in FIG. 1, the guide 50 includes a first guide 51 disposed between the feeder 20 and the first transport roller 61 in the transport direction and a second guide 52 disposed between the second transport roller 62 and the take-up portion 80. In other words, the first guide 51 and the second guide 52 are disposed upstream and downstream, respectively, of the support 30 in the transport direction.

The first guide 51 has a curved portion 53 extending obliquely upward to the downstream side (front side) in the transport direction and a flat portion 54 extending in a direction that intersects or is perpendicular to the vertical direction Z. The first guide 51 partly defines a feed opening 12 through which the medium M enters the housing 11. The first guide 51 supports the medium M from below and guides the medium M sent by the feeder 20 to the support 30.

Hereinafter, an area over the curved portion 53 of the first guide 51 is referred to as a second area A2. The second area A2 is an area upstream of the feed opening 12 in the transport direction and outside the housing 11. In this embodiment, the curved portion 53 is a bent portion protruding obliquely upward to the upstream side (rear side) in the transport direction.

The second guide 52 includes a flat portion 55 extending so as to intersect or be perpendicular to the vertical direction Z and a curved portion 56 extending obliquely downward to the downstream side (front side) in the transport direction. The second guide 52 partly defines a discharge opening 13 through which the medium M is discharged from the housing 11. The second guide 52 supports the medium M from below and guides the medium M transported from the support 30 to the take-up portion 80.

The heater 70 is disposed outside the housing 11 and faces the second guide 52. The heater 70 heats a liquid droplet receiving surface of the medium M, which is transported on the second guide 52, in order to accelerate evaporation of solvent (water, for example) in the liquid droplets deposited on the medium M. The heater 70 may be built in the second guide 52 or may be disposed inside the housing 11.

The take-up portion 80 includes a take-up roller 81 around which the long medium M is wound. The take-up portion 80 takes up the medium M when the take-up roller 81 is rotated in the counterclockwise direction in FIG. 1.

As illustrated in FIG. 2, the maintenance portion 90 is disposed at a position (hereinafter, may be referred to as a home position) adjacent to the support 30 in the width direction X. The maintenance portion 90 includes a cap 91 having a box shape with a closed bottom. The cap 91 is movable toward or away from the liquid droplet ejecting portion 42 supported by the carriage 43 positioned at the home position. The cap 91 defines a closed space for enclosing openings of the nozzles 41 when in contact with the liquid droplet ejecting portion 42.

The maintenance portion 90 prevents liquid droplets (solvent in the liquid droplets) on the nozzles 41 of the liquid droplet ejecting portion 42 from evaporating by using the closed space defined by the cap 91. Thus, the nozzles 41 are prevented from drying.

As illustrated in FIG. 1, the air flow generator 100 includes a first outlet 101 opening toward an inner space of the housing 11, a second outlet 102 opening toward the outside of the housing 11, an air supplier 103 configured to send air, and a gas chamber 104 to which the air supplier 103 sends the air.

The air flow generator 100 includes a first communication passage 105 allowing communication between the gas chamber 104 and the first outlet 101, a second communication passage 106 allowing communication between the gas chamber 104 and the second outlet 102, a switching portion 107 configured to change the communication state between the gas chamber 104 and the first outlet 101, and a heating portion 108 configured to heat the air passing through the second communication passage 106.

The first outlet 101 is positioned above the guide shafts 44 in the vertical direction and opens toward the support 30. The second outlet 102 is positioned at the back of the housing 11 and opens toward the curved portion 53 of the first guide 51. The air supplier 103 may be any fan configured to send air. As illustrated in FIG. 1 and FIG. 2, a plurality of air suppliers 103 are disposed in the gas chamber 104 and arranged in the width direction X.

The switching portion 107 includes an opening/closing member 109 movable in a direction intersecting a flow direction of the air in the first communication passage 105 (left and right direction in FIG. 1). The opening/closing member 109 moves between a closed position and an open position. The opening/closing member 109 in the closed position closes a communication portion through which the first communication passage 105 and the gas chamber 104 are in communication with each other, and the opening/closing member 109 in the open position opens the communication portion.

The switching portion 107 allows communication between the first outlet 101 (first communication passage 105) and the gas chamber 104 by moving the opening/closing member 109 to the open position. This state is referred to as a communication state. The switching portion 107 prevents the communication between the first outlet 101 (first communication passage 105) and the gas chamber 104 by moving the opening/closing member 109 to the closed position. This state is referred to as a non-communication state.

The heating portion 108 is fixed on an inner wall of the second communication passage 106 and is configured to heat the second communication passage 106 across the overall length of the second communication passage 106 in the width direction X. The heated second communication passage 106 heats the air passing therethrough.

The air flow generator 100 activates the air supplier 103 to force the air to be expelled toward a portion of the medium M supported by the support 30 through the first outlet 101. As a result, the air flow is created in the first area A1. In addition, the air flow generator 100 forces the air to be expelled toward a portion of the medium M supported by the first guide 51 through the second outlet 102. As a result, the air flow is created in the second area A2. Hereinafter, the air flow created in the first area A1 may be referred to as a first air flow AF1, and the air flow created in the second area A2 may be referred to as a second air flow AF2.

The above-described air flow generator 100 has a length, which is measured in the width direction X, substantially equal to the length of the support 30. With this configuration, the air flow generator 100 is able to send the air toward the overall area of the medium M, which is supported by the support 30, in the width direction X.

Figure 3:
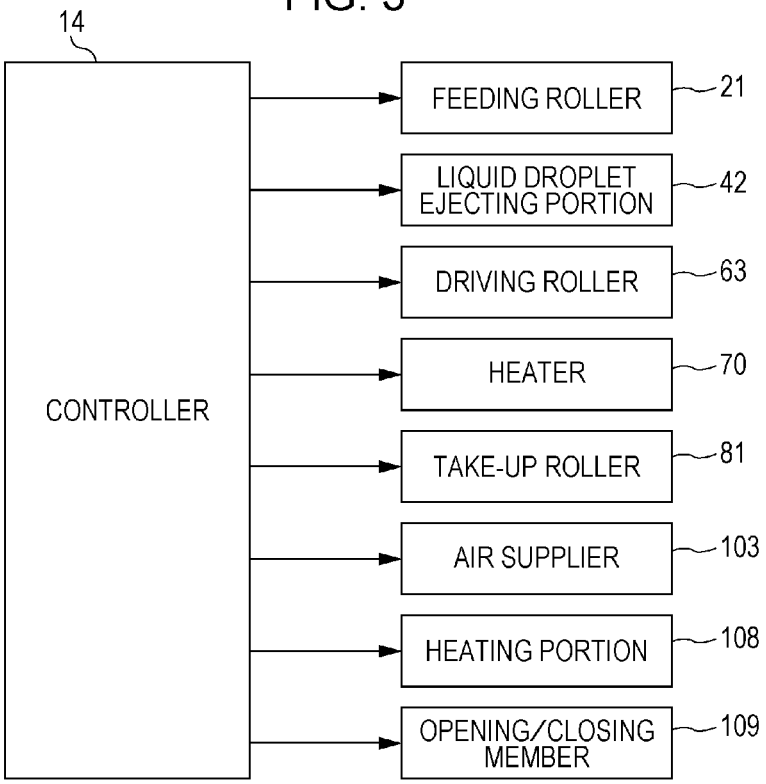
FIG. 3 is a block diagram indicating an electrical configuration of the liquid droplet ejecting apparatus.

The electrical configuration of the liquid droplet ejecting apparatus 10 is described with reference to FIG. 3. As illustrated in FIG. 3, the liquid droplet ejecting apparatus 10 in this embodiment includes a controller 14 configured to control the overall apparatus. The controller 14 controls the feeding roller 21, the liquid droplet ejecting portion 42, the driving roller 63, the heater 70, the take-up roller 81, the air supplier 103, the heating portion 108, and the opening/closing member 109.

In the liquid droplet ejecting apparatus 10, the feeder 20 and the transport unit 60 are activated to perform a transport operation in order to transport the medium M in the transport direction by a predetermined distance before the liquid droplets are ejected to the medium M. Then, an ejection operation is performed to eject the liquid droplets from the liquid droplet ejecting portion 42 to the medium M supported by the support 30 with the carriage 43 being moved in the width direction X. In the liquid droplet ejecting apparatus 10, the transport operation and the ejection operation are alternately performed to sequentially form an area on which the liquid droplets are deposited having a predetermined length in the transport direction.

During the ejection operation, a mist of droplets smaller than the liquid droplets may be generated when the liquid droplets are ejected from the liquid droplet ejecting portion 42. The mist may float in the area (first area A1) over the medium M supported by the support 30. Instead of or in addition to the mist, foreign substances such as dust may float in the first area A1. If the foreign substances such as the mist are allowed to keep floating in the housing (particularly, in the first area A1), the foreign substances may enter the nozzles 41 of the liquid droplet ejecting portion 42, resulting in deterioration of liquid droplet ejecting performance, or generating a blot on the medium M or on any other component possibly due to adhesion of the mist.

To solve these problems, an air flow may be created in the first area A1 so as to eliminate the foreign substances. However, the following problems may occur when the air flow is created in the first area A1. The air flow created in the first area A1 may have an influence on the traveling state of the liquid droplets traveling from the liquid droplet ejecting portion 42 to the medium M or may force medium dust (paper dust) and foreign substances into the area where the liquid droplets travel. The traveling state of the liquid droplets herein includes a traveling speed and a traveling direction of the liquid droplets and deposition positions of the ink droplets on the medium M.

In this embodiment, when the liquid droplet ejecting portion 42 faces the medium M in the ejection direction, i.e., when the liquid droplet ejecting portion 42 is ready to eject the liquid droplets to the medium M, the controller 14 limits the creation of the first air flow AF1 in the first area A1. When the liquid droplet ejecting portion 42 does not face the medium M in the ejection direction, i.e., when the liquid droplet ejecting portion 42 does not eject the liquid droplets to the medium M, the controller 14 allows the creation of the first air flow AF1 in the first area A1.

Specifically, the controller 14 instructs the switching portion 107 to be in the non-communication state when the liquid droplet ejecting portion 42 (indicated by a solid line in FIG. 2) faces the medium M in the ejection direction. The controller 14 instructs the switching portion 107 to be in the communication state when the liquid droplet ejecting portion 42 (indicated by a two-dotted chain line in FIG. 2) does not face the medium M in the ejection direction.

In other words, since the medium M is transported at least while the liquid droplets are not ejected in this embodiment, it can be said that the controller 14 instructs the switching portion 107 to be in the non-communication state while the medium M is not being transported and instructs the switching portion 107 to be in the communication state while the medium M is being transported.

Figure 4:
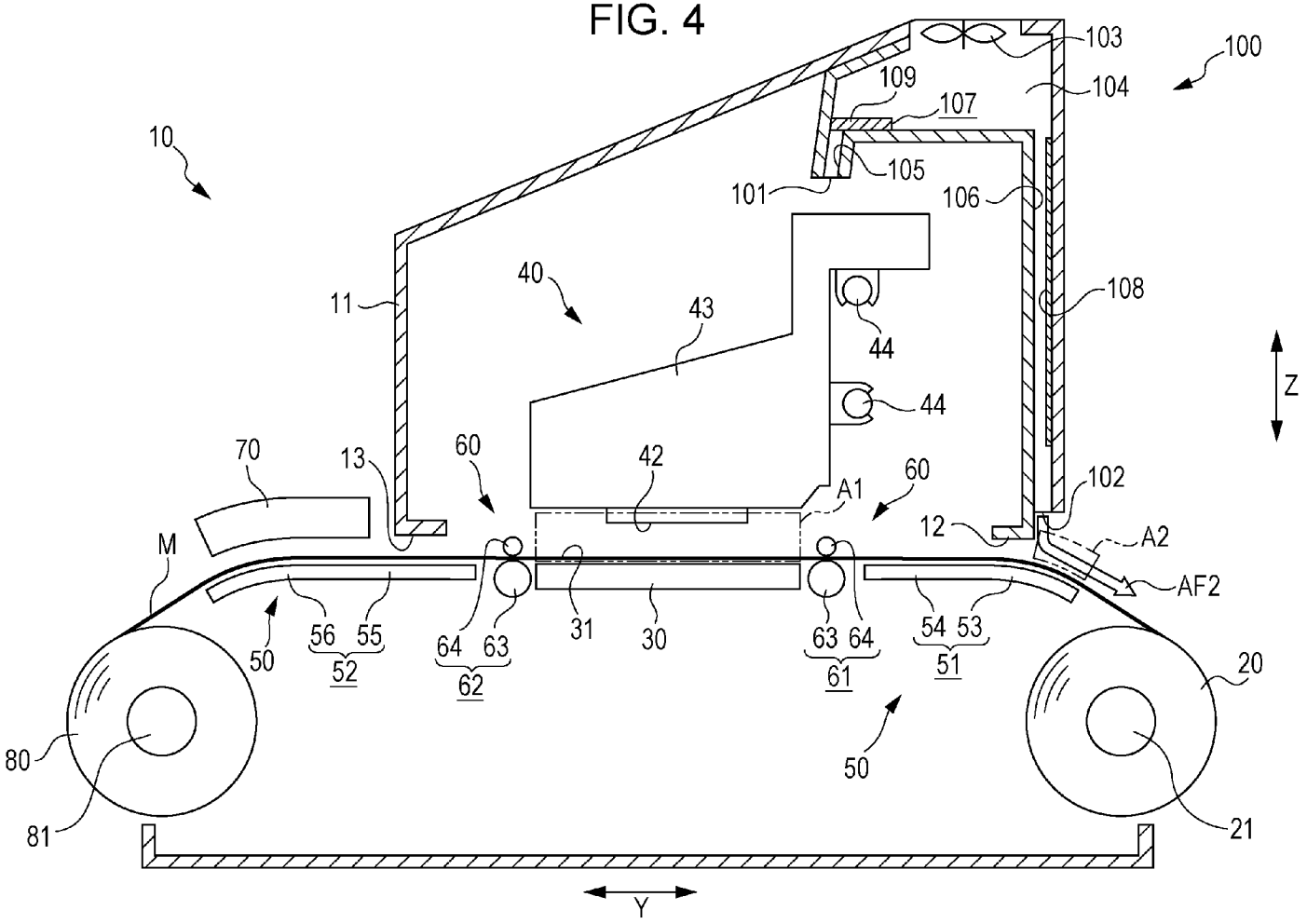
FIG. 4 is a cross-sectional side view illustrating the liquid droplet ejecting apparatus in which the liquid droplet ejecting portion faces the medium.
Figure 5:
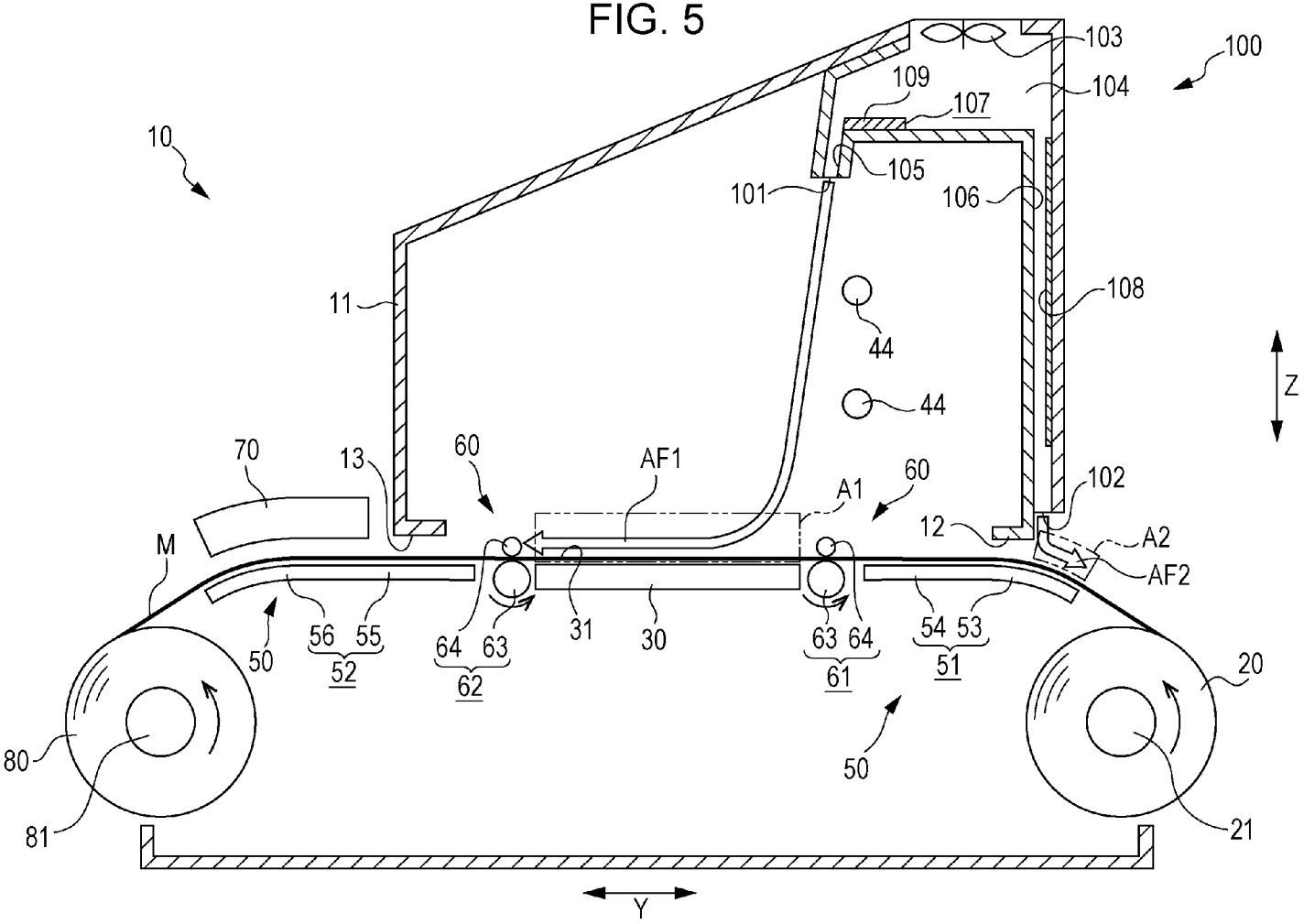
FIG. 5 is a cross-sectional side view illustrating the liquid droplet ejecting apparatus in which the liquid droplet ejecting portion does not face the medium.

With reference to FIG. 4 and FIG. 5, the operation of the liquid droplet ejecting apparatus 10 is described. The liquid droplet ejecting apparatus 10 repeats the ejection operation and the transport operation as described above to sequentially eject the liquid droplets to the medium M being transported. As illustrated in FIG. 4, when the liquid droplet ejecting portion 42 faces the medium M in the ejection direction (i.e., during the ejection operation), the opening/closing member 109 of the air flow generator 100 is moved to the closing position such that the switching portion 107 is in the non-communication state.

This prevents the air from being expelled through the first outlet 101 to the medium M supported by the support 30, preventing creation of the first air flow AF1 in the first area A1. Thus, during the ejection operation, the influence of the air flow on the traveling state of the liquid droplets, which are ejected from the liquid droplet ejecting portion 42 to the medium M, is prevented, and the influence of the foreign substances, which entered the space where the liquid droplets travel, on the traveling state of the liquid droplets is prevented.

In this embodiment, the gas chamber 104, to which the air supplier 103 sends the air, is always in communication with the second communication passage 106 irrespective of the position of the opening/closing member 109. Thus, during the ejection operation, the air is expelled through the second outlet 102 toward the medium M guided by the first guide 51 and collides with a portion of the medium M on the curved portion 53 of the first guide 51. As a result, the second air flow AF2 (impinging flow) is created.

Since the air is expelled through the second outlet 102 downwardly in the vertical direction, and the curved portion 53 of the first guide 51 extends obliquely upward to the downstream side in the transport direction, the second air flow AF2 flows toward the upstream side in the transport direction along the portion of the medium M on the curved portion 53 of the first guide 51. This configuration enables the foreign substances on the surface of the medium M sent by the feeder 20 to be eliminated before the medium M is transported into the housing 11.

During the ejection operation, since the switching portion 107 is in the non-communication state, the air sent by the air supplier 103 to the gas chamber 104 flows out of the gas chamber 104 only through the second outlet 102. This increases the second air flow AF2 compared with the case where the switching portion 107 is in the communication state, and thus the foreign substances in the second area A2 are more reliably eliminated.

In addition, since the second communication passage 106 is heated by the heating portion 108, the second air flow AF2 formed of the air passed through the second communication passage 106 is heated. Thus, the second air flow AF2 reduces the moisture in the medium M guided by the first guide 51.

As illustrated in FIG. 5, when the liquid droplet ejecting portion 42 does not face the medium M in the ejection direction (i.e., during the transport operation indicated by solid arrows in FIG. 5), the opening/closing member 109 of the air flow generator 100 is moved to the open position such that the switching portion 107 is in the communication state.

This allows the air to be expelled through the first outlet 101 to the medium M supported by the support 30 and to collide with the medium M. As a result, the first air flow AF1 is created. Herein, the air is expelled through the first outlet 101 in a direction obliquely downward to the downstream side in the transport direction, and the support 30 extends in the direction intersecting or perpendicular to the vertical direction Z. Thus, the first air flow AF1 flows to the downstream side in the transport direction along the medium M supported by the support 30.

With this configuration, the mist generated by the ejection of liquid droplets from the liquid droplet ejecting portion 42 or the foreign substances such as dust floating in the first area A1 is discharged from the housing 11 through the discharge opening 13. Since the first air flow AF1 is created during the transport operation, the influence of the first air flow AF1 on the traveling state of the droplets, which are ejected from the liquid droplet ejecting portion 42 to the medium M, is prevented, and the influence of the foreign substances such as dust, which entered the space where the liquid droplets travel, on the traveling state of the droplets is prevented.

In this embodiment, the gas chamber 104 to which the air supplier 103 sends the air is always in communication with the second communication passage 106 irrespective of the position of the opening/closing member 109. Thus, as in the ejection operation, during the transport operation, the second air flow AF2 is created in an area through which the medium M passes. This enables the foreign substances on the surface of the medium M sent by the feeder 20 to be eliminated before the medium M is transported into the housing 11.

The above-described embodiment provides the following advantages.

(1) When the liquid droplet ejecting portion 42 faces the medium M in the ejection direction, creation of the first air flow AF1 in the first area A1 is limited so as not to have an influence on the traveling state of the liquid droplets, which are ejected from the liquid droplet ejecting portion 42 to the medium M supported by the support 30. When the liquid droplet ejecting portion 42 does not face the medium M in the ejection direction, creation of the first air flow AF1 in the first area A1 is allowed so as to eliminate foreign substances floating in the first area A1, such as mist, from the first area A1.

In such a case, since the liquid droplet ejecting portion 42 does not face the support 30, foreign substances such as mist carried by the first air flow AF1 do not become attached to the liquid droplet ejecting portion 42. Thus, irrespective of the strength of the first air flow AF1, the first air flow AF1 is able to eliminate the foreign substances floating in the first area A1 over the support 30 without having an influence on the traveling state of the liquid droplets ejected from the liquid droplet ejecting portion 42.

(2) In addition to the first air flow AF1 in the first area A1, the second air flow AF2 is created in the second area A2, which is positioned upstream of the support 30 in the transport direction and through which the medium M passes. With this configuration, the second air flow AF2 is able to eliminate substances such as dust on the surface of the medium M to be transported to the support 30. As a result, the liquid droplets are ejected from the liquid droplet ejecting portion 42 to the medium M having a smaller amount of foreign substances thereon.

(3) The switching portion 107 is switchable between the communication state and the non-communication state. When the liquid droplet ejecting portion 42 faces the medium M in the ejection direction, the switching portion 107 is in the non-communication state. This limits creation of the first air flow AF1 in the first area A1 while allowing creation of the second air flow AF2 in the second area A2. When the liquid droplet ejecting portion 42 does not face the medium M in the ejection direction, the switching portion 107 is in the communication state. This allows the creation of the first air flow AF1 in the first area A1 and creation of the second air flow AF2 in the second area A2.

In addition, since the air forming the first air flow AF1 is not expelled through the first outlet 101 when the switching portion 107 is in the non-communication state, a large amount of air forming the second air flow AF2 is expelled through the second outlet 102 compared with the case where the switching portion 107 is in the communication state. When the liquid droplet ejecting portion 42 faces the medium M in the ejection direction, the creation of the first air flow AF1 is limited, and the second air flow AF2 is increased compared with the case where the liquid droplet ejecting portion 42 does not face the medium M in the ejection direction. As a result, the foreign substances in the second area A2 are more readily eliminated.

(4) In the liquid droplet ejecting apparatus 10 configured to eject liquid droplets from the liquid droplet ejecting portion 42 supported by the carriage 43, which is configured to reciprocate in the width direction X intersecting the transport direction, the liquid droplets are ejected when the medium M is not transported, and the liquid droplets are not ejected when the medium M is being transported. Thus, the switching portion 107 is switched between the communication state and the non-communication state depending on whether the transport unit 60 is transporting the medium M or not. With this configuration, the state of the switching portion 107 is readily switched since the switching between the non-communication state and the communication state is performed simply depending on whether the medium M is transported or not.

(5) Foreign substances are more likely to be attached to a medium M having a high moisture content than to a medium M having a low moisture content. In the present embodiment, the moisture in the medium M to be transported to the support 30 is likely to evaporate since the present embodiment includes the heating portion 108 configured to heat the second air flow AF2. As a result, foreign substances such as dust are unlikely to be attached to the medium M.

(6) The medium M sent by the feeder 20 is guided to the support 30 by the first guide 51 including the curved portion 53 and the flat portion 54. With this configuration, the medium M at the lower side in the vertical direction is reliably transported to the support 30 positioned at the upper side in the vertical direction by the first guide 51 extending obliquely upward to the downstream side in the transport direction.

(7) The air forming the second air flow AF2 is expelled from a position above the curved portion 53 toward the curved portion 53. Thus, the second air flow AF2 (impinging flow) created by collision of the air with the curved portion 53 is likely to flow toward the upstream side in the transport direction and is unlikely to flow toward the downstream side in the transport direction. Since the second area A2 is positioned over the curved portion 53 of the first guide 51, the second air flow AF2 is unlikely to enter the housing 11 through the feed opening 12. Thus, the foreign substances such as dust eliminated from the surface of the medium M are unlikely to enter the housing 11.

(8) The creation of the first air flow AF1 during the ejection operation typically requires the output of the air supplier 103 to be controlled such that the first air flow AF1 is strong enough to have an influence on the mist generated in the housing 11 and is weak enough to have no influence on the traveling state of the liquid droplet ejected from the liquid droplet ejecting portion 42 to the medium M, for example. However, in the present embodiment, the output of the air supplier 103 does not need to be controlled to limit the creation of the first air flow AF1 during the ejection operation. In addition, the output of the air supplier 103 may be more difficult to be controlled as the liquid droplets, which are ejected from the liquid droplet ejecting portion 42 to the medium M, are smaller. Thus, the present embodiment is more advantageous as the liquid droplets, which are ejected from the liquid droplet ejecting portion 42 to the medium M, are smaller.

The above-described embodiment may be modified as described below.

The foreign substances such as the mist floating in the first area A1 may be readily attached to the medium M if the medium M being transported is electrically charged. To solve the problem, the air supplier 103 may include an ionizer (charge neutralizer). This configuration allows ions necessary for neutralization to be contained in the second air flow AF2, enabling the charge of the electrically charged medium M to be neutralized (eliminated) by the ions. Thus, foreign substances such as the mist are unlikely to be attached to the medium M to be transported into the housing 11.

When the liquid droplet ejecting portion 42 faces the medium M in the ejection direction, the air flow generator 100 may limit the creation of the first air flow AF1 in the first area A1 such that the first air flow AF1 is weak compared with the case where the liquid droplet ejecting portion 42 does not face the medium M in the ejection direction.

The air supplier 103 is not limited to a blower fan. The air supplier 103 may be a suction fun or a suction pump, for example.

The air supplier 103 may include a first air supplier that creates the first air flow AF1 and a second air supplier that creates the second air flow AF2. The first and second air suppliers may be separately controlled.

The heating of the second air flow AF2 is optional, and the creation of the second air flow AF2 is optional.

The medium M may formed of resin, metal, cloth, or paper.

The liquid ejected from the liquid droplet ejecting portion 42 is not limited to the ink, and may be a liquid material including a liquid and particles of functional materials dispersed or mixed in the liquid. The liquid material including a material such as an electrode material or a color material (pixel material) used in production of liquid crystal displays, electro luminescence (EL) displays, or surface emitting displays in a dispersed or dissolved state may be ejected for printing.

This application claims priority under 35 U.S.C. §119 to Japanese Patent Application No. 2015-026566, filed Feb. 13, 2015. The entire disclosure of Japanese Patent Application No. 2015-026566 is hereby incorporated herein by reference.

What is claimed is:

1. A liquid droplet ejecting apparatus comprising:

a transport unit configured to transport a medium in a transport direction;

a support configured to support the medium transported by the transport unit;

a liquid droplet ejecting portion configured to eject liquid droplets to the medium supported by the support;

a carriage configured to reciprocate in a scanning direction intersecting the transport direction while holding the liquid droplet ejecting portion; and an air flow generator configured to create a first air flow in an a first area over the support and configured to create a second air flow in a second area upstream of the support in the transport direction and through which the medium passes, in addition to the first air flow, wherein a direction in which the liquid droplets are ejected from the liquid droplet ejecting portion travel is an ejection direction, and the air flow generator limits creation of the first air flow when the liquid droplet ejecting portion faces the medium in the ejection direction and allows the creation of the first air flow when the liquid droplet ejecting portion does not face the medium in the ejection direction, due to movement of the carriage in the scanning direction, wherein the air flow generator includes:

a first outlet through which air forming the first air flow is expelled;

a second outlet through which air forming the second air flow is expelled;

a gas chamber configured to be in communication with the first outlet and the second outlet;

an air supplier configured to send air to the gas chamber; and a switching portion switchable between a communication state, in which the first outlet and the gas chamber are in communication with each other, and a non-communication state, in which the first outlet and the gas chamber are not in communication with each other.

2. The liquid droplet ejecting apparatus according to claim 1, wherein the switching portion is in the communication state when the transport unit transports the medium and is in the non-communication state when the transport unit does not transport the medium.

3. The liquid droplet ejecting apparatus according to claim 1, wherein the air flow generator further includes a heating portion configured to heat the second air flow.

4. The liquid droplet ejecting apparatus according to claim 1, further comprising a guide extending obliquely upward to a downstream side in the transport direction so as to guide the medium to the support, and the second area is positioned over the guide.

* * * * *